US009144351B2

(12) United States Patent
Ciavarella et al.

(10) Patent No.: US 9,144,351 B2
(45) Date of Patent: Sep. 29, 2015

(54) VACUUM PRIME FOAM PUMPS, REFILL UNITS AND DISPENSERS

(71) Applicants: Nick E. Ciavarella, Seven Hills, OH (US); Michael J. Gallo, Twinsburg, OH (US)

(72) Inventors: Nick E. Ciavarella, Seven Hills, OH (US); Michael J. Gallo, Twinsburg, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 14/289,132

(22) Filed: May 28, 2014

(65) Prior Publication Data

US 2014/0353334 A1 Dec. 4, 2014

Related U.S. Application Data

(60) Provisional application No. 61/828,380, filed on May 29, 2013.

(51) Int. Cl.

| | |
|---|---|
| ***B67D 7/76*** | (2010.01) |
| ***A47K 5/16*** | (2006.01) |
| ***B05B 7/00*** | (2006.01) |
| ***B05B 7/26*** | (2006.01) |
| ***B05B 12/00*** | (2006.01) |

(52) U.S. Cl.

CPC ..... *A47K 5/16* (2013.01); *B05B 7/0037* (2013.01); *B05B 7/267* (2013.01); *B05B 12/002* (2013.01)

(58) Field of Classification Search

CPC ..... A47K 5/14; A47K 5/16; B05B 7/0037; B05B 7/0018; B05B 7/005; B05B 7/0062; B05B 7/267; B05B 12/002

USPC ..... 222/190, 52, 145.5, 145, 6, 145.7

See application file for complete search history.

(56) References Cited

U.S. PATENT DOCUMENTS

| | | | | |
|---|---|---|---|---|
| 4,620,983 | A * | 11/1986 | Zimmer | 427/8 |
| 5,862,954 | A * | 1/1999 | Ehrensperger et al. | 222/190 |
| 7,063,239 | B2 * | 6/2006 | Niada | 222/383.1 |
| 8,579,159 | B2 * | 11/2013 | Ciavarella | 222/135 |
| 2006/0011655 | A1 * | 1/2006 | Ophardt | 222/190 |

(Continued)

FOREIGN PATENT DOCUMENTS

| | | | |
|---|---|---|---|
| EP | 2135538 | A1 | 12/2009 |
| WO | 2012154642 | A1 | 11/2012 |

OTHER PUBLICATIONS

Search Report from International Application No. PCT/US2014/039662, date of mailing Jan. 15, 2015.

*Primary Examiner* — Lien Ngo

(74) *Attorney, Agent, or Firm* — Calfee, Halter & Griswold LLP

(57) ABSTRACT

Exemplary embodiments of foam pumps, refill units and dispenser systems are disclosed herein. Some embodiments have a foam pump that includes a chamber having a liquid inlet, a vacuum outlet, a pressurized air inlet and a liquid air mixture outlet. An exemplary foam pump includes a liquid inlet valve to allow liquid to enter the chamber and to prevent liquid from exiting the chamber through the liquid inlet. Vacuum pressure applied to the vacuum outlet causes fluid to flow through the liquid inlet, past the liquid inlet valve and into the chamber. Pressurized air flows through the pressurized air inlet and mixes with the liquid and the liquid air mixture is forced out of the liquid air mixture outlet. The foam pump includes a mix media. The liquid air mixture flows through the mix media and flows through an outlet to be dispensed as a foam.

20 Claims, 6 Drawing Sheets

(56) References Cited

U.S. PATENT DOCUMENTS

2006/0108380 A1* 5/2006 Ciavarella ..... 222/321.9
2011/0070349 A1* 3/2011 Burri et al. ..... 426/474
2012/0267396 A1 10/2012 Quinlan, Jr.
2012/0285992 A1* 11/2012 Ciavarella et al. ..... 222/138
2013/0032614 A1* 2/2013 Babikian et al. ..... 222/190

* cited by examiner

VACUUM PRIME FOAM PUMPS, REFILL UNITS AND DISPENSERS

RELATED APPLICATIONS

This application claims priority to and the benefits of U.S. Provisional Patent Application Ser. No. 61/828,380 filed on May 29, 2013 and entitled Vacuum Prime Foam Pumps, Refill Units and Dispensers, which is incorporated herein by reference in its entirety.

TECHNICAL FIELD

The present invention relates generally to pumps, refill units for dispensers, and dispensers, and more particularly to foam pumps, refill units and foam dispensers.

BACKGROUND OF THE INVENTION

Liquid dispensers, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Many dispensers are refillable with refill units that comprise a liquid pump, an air compressor and a container. The refills are sand disposable when the liquid held within the refill unit is emptied.

SUMMARY

Exemplary embodiments of foam pumps, refill units and dispenser systems are disclosed herein. Some embodiments have a foam pump that includes a chamber having a liquid inlet, a vacuum outlet, a pressurized air inlet and a liquid air mixture outlet. An exemplary foam pump includes a liquid inlet valve located in fluid communication with the liquid inlet to allow liquid to enter the chamber and to prevent liquid from exiting the chamber through the liquid inlet. Vacuum pressure applied to the vacuum outlet causes fluid to flow through the liquid inlet, past the liquid inlet valve and into the chamber. Pressurized air flows through the pressurized air inlet and mixes with the liquid and the liquid air mixture is forced out of the liquid air mixture outlet. The foam pump includes a mix media in fluid communication with the liquid air mixture outlet. The liquid air mixture flows through the mix media and flows through an outlet to be dispensed as a foam.

Exemplary methods of operating a foam pump are also disclosed herein. One method of operating a foam pump includes providing a refill unit having foamable liquid container with a supply of foamable liquid. The refill unit includes a chamber in fluid communication with the foamable liquid container, a vacuum outlet into the chamber, a pressurized air inlet into the chamber; and a liquid air mixture outlet. The exemplary methodology includes connecting the refill unit to a dispenser, drawing a vacuum pressure on the vacuum outlet into the chamber to draw liquid from the foamable liquid container into the chamber, forcing pressurized air into the chamber to mix with the liquid; and forcing the pressurized liquid air mixture through a mix media and out of an outlet.

An exemplary dispenser includes a vacuum pump, an air pump, circuitry for controlling the vacuum pump and the air pump and a sensor for sensing an object. A refill unit for releasably connecting to the vacuum pump and the air pump is also provided. The refill unit includes a liquid container for holding a foamable liquid and a chamber. The chamber includes a vacuum outlet port, an air pressure inlet port, a liquid inlet, a liquid air mixture outlet, a mix media, and a dispense outlet. The vacuum pump applies a negative pressure to the vacuum outlet port; and the air pump applies a positive pressure to the air pressure port when the sensor detects an object.

BRIEF DESCRIPTION OF THE DRAWINGS

These and other features and advantages of the present invention will become better understood with regard to the following description and accompanying drawings in which.

DETAILED DESCRIPTION

Figure 1:
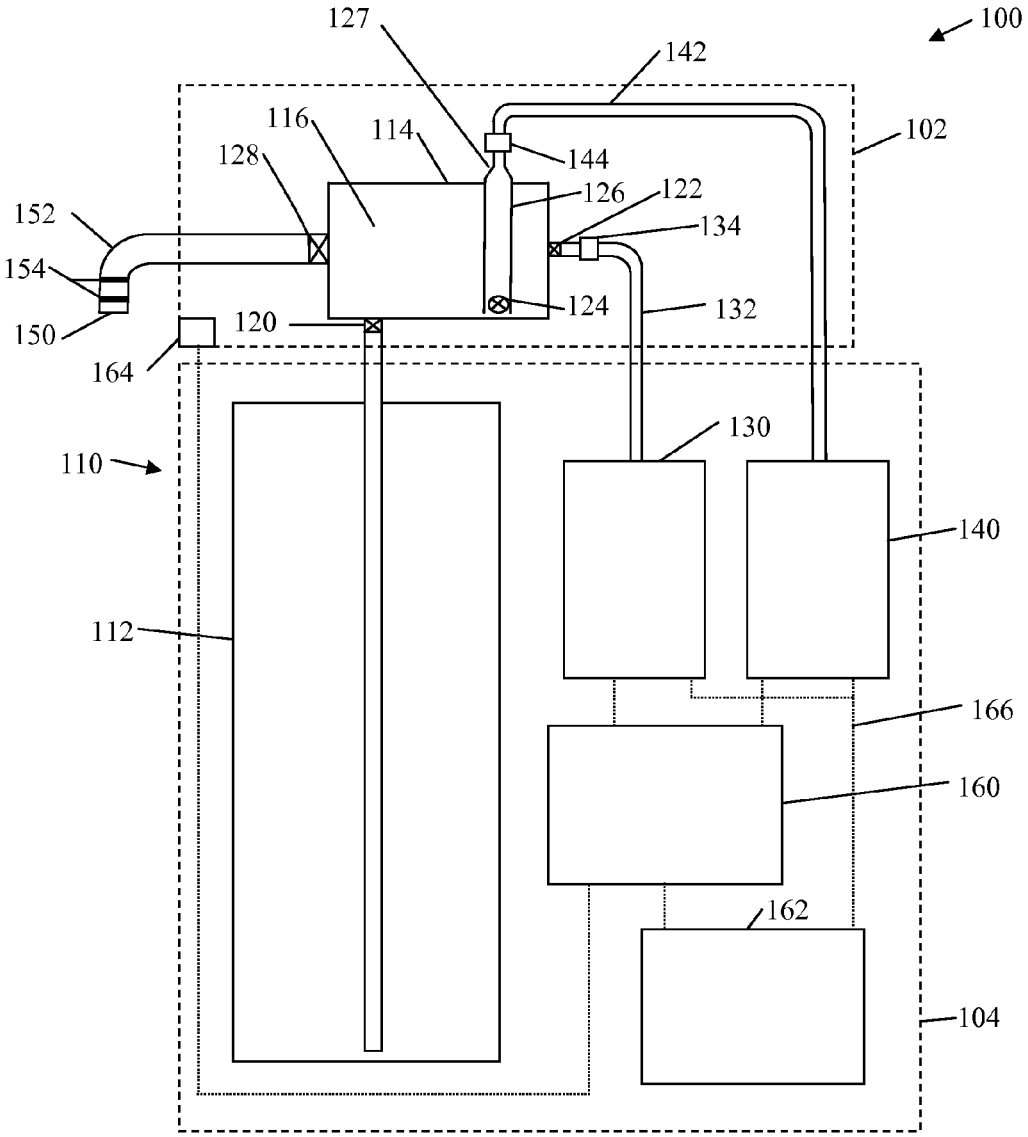
FIG. 1 is a schematic view of an exemplary counter-mount dispenser having a refill unit with installed.
Figure 2:
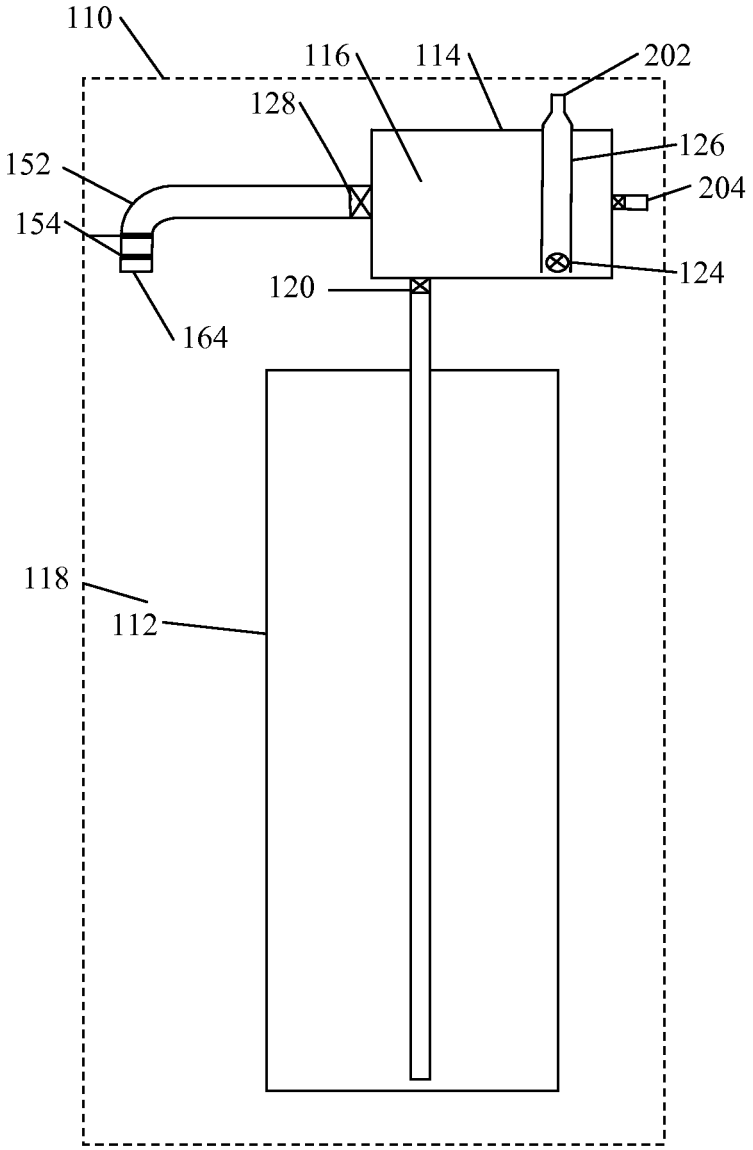
FIG. 2 is a schematic view of an exemplary refill unit for a counter-mount dispenser.

FIG. 1 illustrates an exemplary embodiment of a counter-mount foam dispenser 100. Foam dispenser 100 includes an above the counter portion 102 and a below the counter portion 104. Foam dispenser 100 includes a refill unit 110. Refill unit 110 includes a container 112, a dip tube 118, a housing 114, a vacuum outlet port 202 (FIG. 2), a pressurized air inlet port 204, a dispense tube 152 and an outlet 150. Housing 114 forms a chamber 116. Chamber 116 is shown as being above the counter in FIG. 1, in some embodiments, chamber 116 is located below the counter.

The container 112 forms a liquid reservoir that contains a supply of a foamable liquid within the disposable refill unit 110. In various embodiments, the contained liquid could be for example a soap, a sanitizer, a cleanser, a disinfectant or some other liquid that may be foamable or not foamable. In some embodiments, a liquid pump is used, and in such embodiments, the liquid need not be foamable.

In addition, some embodiments the refill unit includes a one-way liquid inlet check valve 120, a pressurized air inlet check valve 122 and a liquid air mixture outlet valve 128. Check valves 120, 122 and 128 may be any type of one-way check valves. In addition, vacuum outlet port 202 is in fluid communication with a cylindrical shaft 126 having a valve seat 127 located at the top of the cylindrical shaft 126. A floating ball valve 124 is located within cylindrical shaft 126. Floating ball valve 124 is sized to allow air to flow around the floating ball valve 124 and out of the vacuum outlet port 202.

Foam dispenser 100 includes a pressurized air source 130, such as for example, an air pump, and a vacuum pressure source 140, such as a vacuum pump. Foam dispenser 100 includes a conduit 142 extending from vacuum source 140 to connector 144. Connector 144 releasably connects to vacuum outlet port 202. Similarly a conduit 132 extends from air pressure source 130 to connector 134. Connector 134 releasably connects to air pressure inlet port 204. Connectors 144, 134 may be any type of connectors, such as for example, compression connectors, friction fit connectors, snap-on connectors, a quick disconnect, or the like.

In this exemplary embodiment, foam dispenser 100 is a touch-free dispenser and is electronically activated. Foam dispenser 100 includes an object sensor 164. Object sensor 164 may be any type of object sensor, such as, for example, an infrared sensor, a motion sensor or the like. Circuitry 160 is also included in foam dispenser 100 as well as a power source 162. Power source 162 may be, for example, one or more batteries, a transformer connected to a 120 VAC power source, or the like. Electrical connections 166 place the object sensor, circuitry 160, power source 162, vacuum pump 140 and 130 in circuit communication.

"Circuit communication" indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

Also, voltages and values representing digitized voltages are considered to be equivalent for the purposes of this application, and thus the term "voltage" as used herein refers to either a signal, or a value in a processor representing a signal, or a value in a processor determined from a value representing a signal.

"Signal," includes, but is not limited to one or more electrical signals, analog or digital signals, one or more computer instructions, a bit or bit stream, or the like.

"Logic," synonymous with "circuit" includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

The values identified in the detailed description are exemplary and they are determined as needed for a particular dispenser and/or refill design. Accordingly, the inventive concepts disclosed and claimed herein are not limited to the particular values or ranges of values used to describe the embodiments disclosed herein.

Circuitry 160, vacuum source 140, pressurized air source 130, object sensor 164 and power source 162 are generically illustrated because many different types and configurations of these components may be used and these components are known by those skilled in the art.

During operation, a refill unit 110 is installed in a dispenser 100. When an object is detected by object sensor 164, circuitry 160 causes vacuum pump 140 to draw a vacuum in chamber 116 through conduit 142. The vacuum pressure in chamber 116 seats liquid air outlet valve 128 closed. The pressurized air source 130 and one-way air inlet valve 122 are configured to prevent air from entering the chamber 116 during priming. In some embodiments, one-way air inlet valve 122 is an electrically activated manual valve. While priming, the vacuum pressure in chamber 116 overcomes the cracking pressure of one-way liquid inlet valve 120 and foamable liquid from container 112 travels up dip tube 118 and into chamber 116. Floating ball valve 124, which is container in cylindrical tube 126 rises as the volume of liquid in chamber 116 increases. Once chamber 116 is filled with the desired amount of foamable liquid, floating ball valve 124 seals against seat 127 and prevents liquid from flowing up into conduit 142.

In some embodiments, when the floating ball valve 124 seals against seat 127, the voltage to vacuum pressure source 140 spikes. Circuitry 160 detects the spike and shuts off vacuum source 140. In some embodiments, the vacuum pressure source 140 operates for a specified period of time that is calculated to ensure that the chamber 116 has the proper level of fluid.

In some embodiments, the vacuum source 140 remains on to ensure chamber 116 remains sealed off when pressurized air source 130 causes pressurized air to flow into chamber 116. The pressurized air mixes with the foamable liquid in chamber 116 and the liquid air mixture is forced out of liquid air outlet valve 128 through mix media 154, which may be, for example, one or more screens, and is dispensed as a foam.

In some embodiments, vacuum source 130 is energized to draw foamable liquid into chamber 116 and is de-energized once the chamber 116 is filled with foamable liquid. In this exemplary embodiment, the foam dispenser 110 is pre-primed and ready for the next dispense cycle. In some embodiments, floating ball valve 124 is replaced with a different type of valve, such as, for example, an electrically operated mechanical valve. In some embodiments, an electrically activated spool valve may be used for both the vacuum outlet valve 124 and the air pressure inlet valve 122. The spool valve may alternately shift positions from between an open vacuum outlet valve and closed air pressure inlet valve to a closed vacuum outlet valve and an open air pressure inlet valve. These exemplary embodiments, or portions thereof, may be used in whole or in part with all of, or portions of, the other exemplary embodiments disclosed herein.

Figure 3:
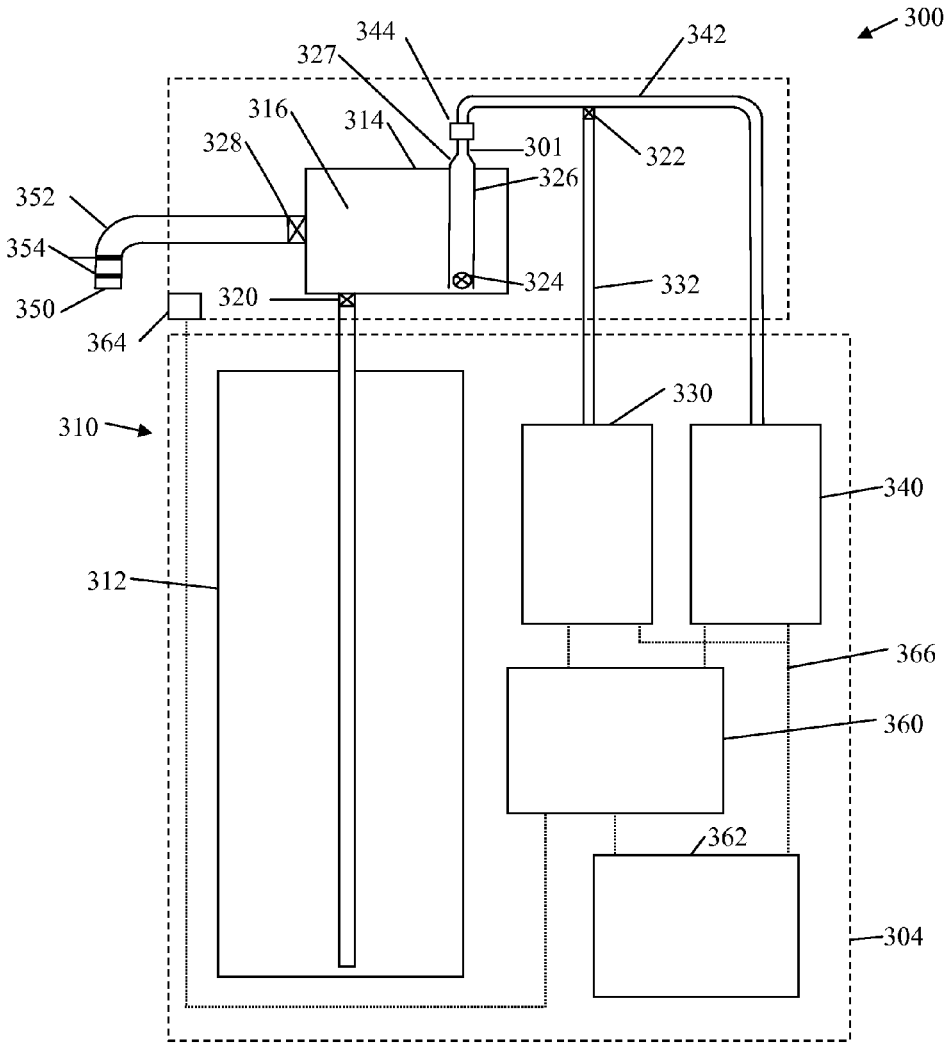
FIG. 3 is a schematic view of another exemplary counter-mount dispenser having a refill unit with installed.

FIG. 3 illustrates another exemplary embodiment of a counter-mount foam dispenser 300. Foam dispenser 300 includes an above the counter portion 302 and a below the counter portion 304. Foam dispenser 300 includes a refill unit 310. Refill unit 310 includes a container 312, a dip tube 318, a housing 314, a port 301, a dispense tube 352 and an outlet 350. Housing 314 forms a chamber 316. Although chamber 316 is shown as being above the counter in FIG. 3, in some embodiments, chamber 316 is located below the counter.

The container 312 forms a liquid reservoir that contains a supply of a foamable liquid within the disposable refill unit 310. In various embodiments, the contained liquid could be for example a soap, a sanitizer, a cleanser, a disinfectant or some other liquid that may be foamable or not foamable. In some embodiments, a liquid pump is used, and in such embodiments, the liquid need not be foamable.

In addition, some embodiments the refill unit includes a one-way liquid inlet check valve 320 and a liquid air mixture outlet valve 128. Check valves 320 and 328 may be any type of one-way check valves. In addition, port 301 is in fluid communication with a cylindrical shaft 326 having a valve seat 327 located at the top of the cylindrical shaft 326. A floating ball valve 324 is located within cylindrical shaft 126. Floating ball valve 324 is sized to allow air to flow around the floating ball valve 324 and in and out of port 202.

Foam dispenser 300 includes a pressurized air source 330, such as for example, an air pump, and a vacuum pressure source 340, such as a vacuum pump. Foam dispenser 300 includes a conduit 342 extending from vacuum source 340 to connector 344. A conduit 332 extends from pressurized air source 330 to conduit 342. A one-way check valve 322 is included in conduit 332. Connector 344 releasably connects to port 301. Connector 344 may be any type of connector, such as for example, compression connectors, friction fit connectors, snap-on connectors, or the like.

In this exemplary embodiment, foam dispenser 300 is a touch-free dispenser and is electronically activated. Foam dispenser includes an object sensor 364. Object sensor 364 may be any type of object sensor, such as, for example, an infrared sensor, a motion sensor or the like. Circuitry 360 is also included in foam dispenser 300 as well as a power source 362. Power source 362 may be, for example, one or more batteries, a transformer connected to a 120 VAC power source, or the like. Electrical connections 366 place the object sensor, circuitry 360, power source 362, vacuum pump 340 and pressurized air source 330 in circuit communication.

Circuitry 360, vacuum source 340, pressurized air source 330, object sensor 364 and power source 362 are generically illustrated because many different types and configurations of these components may be used and these components are known by those skilled in the art.

The exemplary foam dispenser 300 operates in substantially the same way as described above with respect to foam dispenser 100 except that pressurized air source 330 and vacuum source 340 connect to chamber 116 through the same port 301. Thus, the vacuum pressure outlet and air pressure inlet art the same port 301 and the pressurized air source 330 and vacuum source 340 are not energized at the same time.

Figure 4:
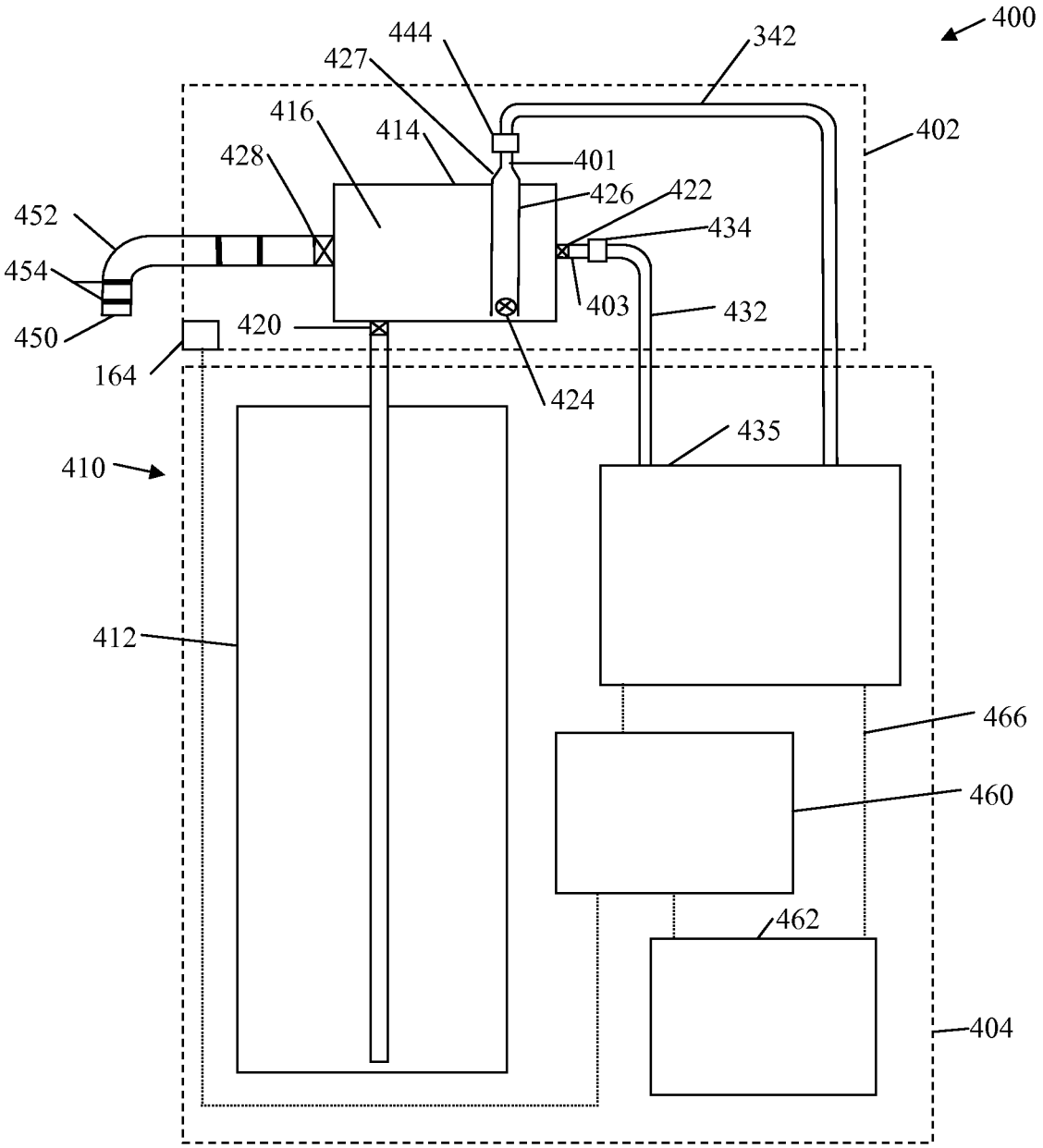
FIG. 4 is a schematic view of another exemplary counter-mount dispenser having a refill unit with installed.

FIG. 4 illustrates another exemplary embodiment of a counter-mount foam dispenser 400. Foam dispenser 400 includes an above the counter portion 402 and a below the counter portion 404. Foam dispenser 400 includes a refill unit 410. Refill unit 410 includes a container 412, a dip tube 418, a housing 414, a vacuum outlet port 401, a pressurized air inlet port 403, a dispense tube 452 and an outlet 450. Housing 414 forms a chamber 416. Chamber 416 is shown as being above the counter in FIG. 1, in some embodiments, chamber 416 is located below the counter.

The container 412 forms a liquid reservoir that contains a supply of a foamable liquid within the disposable refill unit 410. In various embodiments, the contained liquid could be for example a soap, a sanitizer, a cleanser, a disinfectant or some other liquid that may be foamable or not foamable. In some embodiments, a liquid pump is used, and in such embodiments, the liquid need not be foamable.

In addition, some embodiments the refill unit includes a one-way liquid inlet check valve 420, a pressurized air inlet check valve 422 and a liquid air mixture outlet valve 428. Check valves 420, 422 and 428 may be any type of one-way check valves. In addition, vacuum outlet port 402 is in fluid communication with a cylindrical shaft 426 having a valve seat 427 located at the top of the cylindrical shaft 426. A floating ball valve 424 is located within cylindrical shaft 426. Floating ball valve 424 is sized to allow air to flow around the floating ball valve 424 and out of the vacuum outlet port 402.

Foam dispenser 400 includes an air source 435. Air source 435 is configured to supply a vacuum pressure and a positive air pressure. In some embodiments, air source includes a conduit 442 extending from the air source 435 to connector 444 to provide a vacuum pressure. Connector 444 releasably connects to vacuum outlet port 401. Similarly a conduit 432 extends from air source 435 to connector 134 to provide a pressurized air source. Connector 434 releasably connects to air pressure inlet port 404. Connectors 444, 434 may be any type of connectors, such as for example, compression connectors, friction fit connectors, snap-on connectors, or the like. The exemplary foam dispenser 400 operates in substantially the same way as the foam dispenser 100.

In some embodiments, air source 435 has a single output that may provide either a vacuum pressure or a positive pressure. In such an embodiment, conduit 432, connector e 434, port 403 and one-way check valve 422 are not included and circuitry 460 switches air source 435 between a vacuum pressure and a positive pressure.

In some embodiments, air source 435 includes an air accumulator (not shown). An air accumulator allows for the use of a smaller volume air source. A smaller volume air source has a lower peak operating voltage. It has been discovered that battery life is extended by operating a motor having a lower peak operating voltage for a longer period of time than operating a motor having a higher peak operating voltage for a shorter time. Thus, the smaller volume air source may be run longer and fill an accumulator, such as a tank, or resilient member, with pressurized air and the air from the accumulator is used to pass pressurized air into the chamber. In some embodiments, the air accumulator holds enough pressurized air for about 10 dispenses. In some embodiments, the accumulator holds enough pressurized air for more than 10 dispenses. The volume of the accumulator may be sized differently to accommodate use of the dispenser in areas having low traffic areas, such as a small office all the way up to use in high traffic areas, such as, for example, a casino or restaurant. Thus, the dispenser always has enough pressurized air to deliver dispenses of foam even if the air source 435 alone cannot provide a high enough volume of pressurized air.

Figure 5:
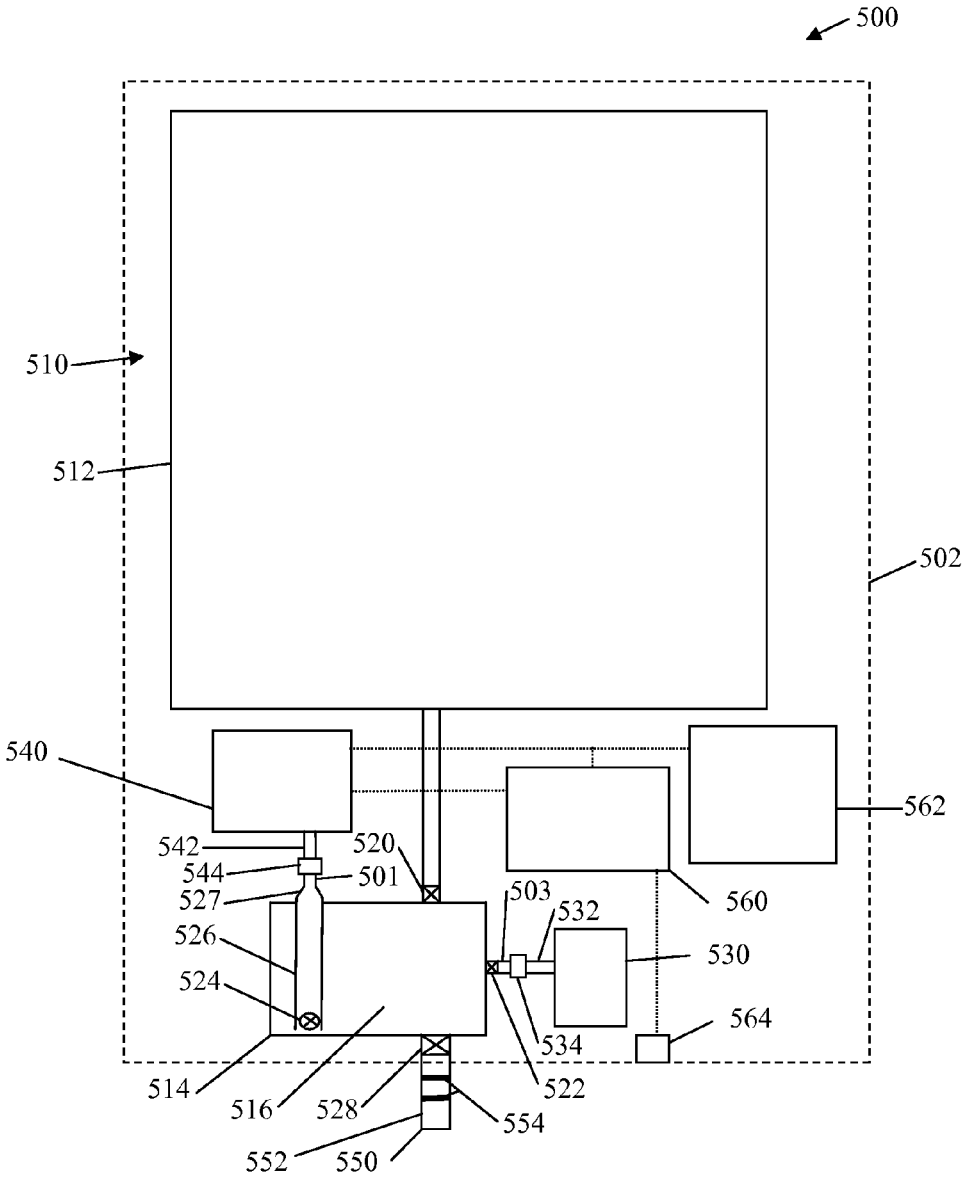
FIG. 5 is a schematic view of an exemplary foam dispenser with a refill unit installed.

FIG. 5 illustrates an exemplary embodiment of a foam dispenser 500. Foam dispenser 500 may be a wall mounted dispenser, a portable dispenser, a dispenser mounted on a stand, or the like. Foam dispenser 500 illustrates an inverted dispenser having the container 512 located above the chamber 516.

Foam dispenser 500 includes a refill unit 510. Refill unit 510 includes a container 512, a dip tube 518, a housing 514, a vacuum outlet port 501, a pressurized air inlet port 503, a dispense tube 552 and an outlet 550. Housing 514 forms a chamber 516.

The container 512 forms a liquid reservoir that contains a supply of a foamable liquid within the disposable refill unit 510. In various embodiments, the contained liquid could be for example a soap, a sanitizer, a cleanser, a disinfectant or some other liquid that may be foamable or not foamable. In some embodiments, a liquid pump is used, and in such embodiments, the liquid need not be foamable.

In addition, some embodiments the refill unit 510 includes a one-way liquid inlet check valve 520, a pressurized air inlet check valve 522 and a liquid air mixture outlet valve 528. Check valves 520, 522 and 528 may be any type of one-way check valves. In addition, vacuum outlet port 501 is in fluid communication with a cylindrical shaft 526 having a valve seat 527 located at the top of the cylindrical shaft 526. A floating ball valve 524 is located within cylindrical shaft 526. Floating ball valve 524 is sized to allow air to flow around the floating ball valve 524 and out of the vacuum outlet port 501.

Foam dispenser 500 includes a pressurized air source 530, such as for example, an air pump, and a vacuum pressure source 540, such as a vacuum pump. Foam dispenser 500 includes a conduit 542 extending from vacuum source 540 to connector 544. Connector 544 releasably connects to vacuum outlet port 501. Similarly a conduit 532 extends from air pressure source 530 to connector 534. Connector 534 releasably connects to air pressure inlet port 503. Connectors 544, 534 may be any type of connectors, such as for example, compression connectors, friction fit connectors, snap-on connectors, or the like.

In this exemplary embodiment, foam dispenser 500 is a touch-free dispenser and is electronically activated. Foam dispenser includes an object sensor 564. Object sensor 564 may be any type of object sensor, such as, for example, an infrared sensor, a motion sensor or the like. Circuitry 560 is also included in foam dispenser 500 as well as a power source 562. Power source 562 may be, for example, one or more batteries, a transformer connected to a 120 VAC power source, or the like. Electrical connections 566 place the object sensor, circuitry 560, power source 562, vacuum pump 540 and 530 in circuit communication.

In the exemplary disposable refill unit 510, the container 512 is a collapsible container and is made of thin plastic or plastic-like material. In some embodiments, the container 512 may be non-collapsible during use, or may have another suitable configuration for containing the foamable liquid without leaking. In the event that a non-collapsible container 512 is used, a vent (not shown) may be used to vent the container 512 as liquid is removed from the container 512. The container 512 may advantageously be refillable, replaceable or both refillable and replaceable.

In the event the liquid in the container 512 of the installed disposable refill unit 510 runs out, or the installed refill unit 510 otherwise has a failure, the installed refill unit 510 may be removed from the foam dispenser 500. The empty or failed disposable refill unit 510 may then be replaced with a new disposable refill unit 510. Dispenser 100 is a touch-free dispenser and is electronically activated.

Figure 6:
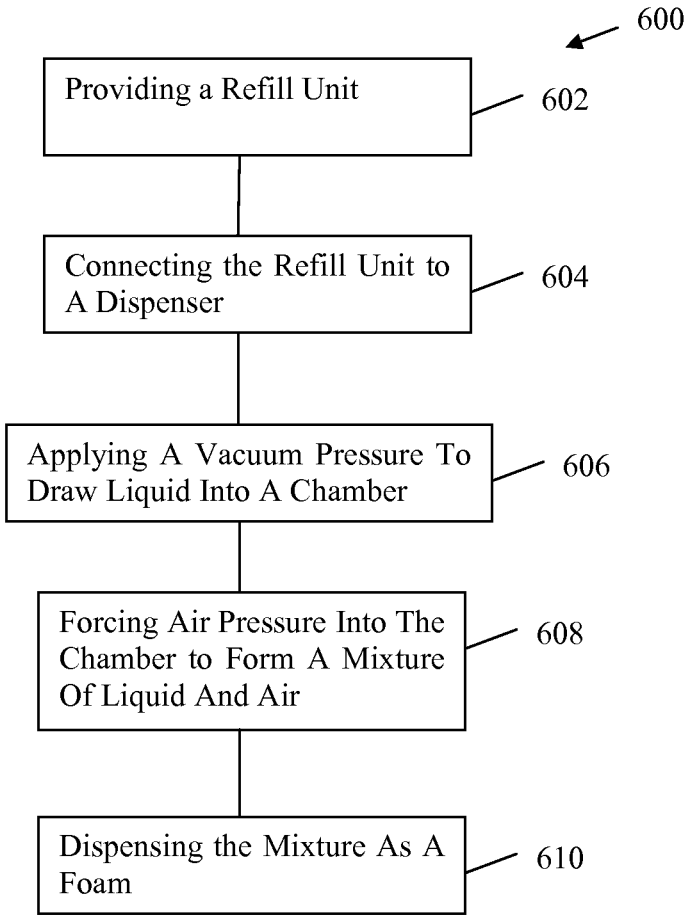
FIG. 6 is a block diagram of an exemplary methodology for operating a foam pump.

FIG. 6 illustrates an exemplary embodiment 600 for operating a foam dispenser. The exemplary methodology begins at block 602 by providing a refill unit. The refill unit is connected to a dispenser at block 604. A vacuum pressure is applied at block 606 to draw liquid into a chamber. Air is forced under pressure into the chamber at block 608 forming a mixture of liquid and air. The mixture of liquid and air is forced out of the dispenser at block 610 in the form of a foam.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A foam pump comprising:

a chamber having a liquid inlet, a vacuum outlet, a pressurized air inlet and a liquid air mixture outlet;

a liquid inlet valve located in fluid communications with the liquid inlet to allow liquid to enter the chamber and prevent liquid from exiting the chamber through the liquid inlet;

a mix media in fluid communication with the liquid air mixture outlet; and an outlet;

wherein vacuum pressure applied to the vacuum outlet causes liquid to flow through the liquid inlet, past the liquid inlet valve and into the chamber;

wherein pressurized air flows through the pressurized air inlet and mixes with the liquid and wherein the liquid air mixture is forced out of the liquid air mixture outlet; and wherein the liquid air mixture flows through the mix media and flows through the outlet to be dispensed as a foam.

2. The foam pump of claim 1 further comprising a vacuum outlet valve, wherein the vacuum outlet valve closes when a desired amount of liquid has been drawn into the chamber.

3. The foam pump of claim 2 wherein the vacuum outlet valve floats on the liquid.

4. The foam pump of claim 2 wherein the vacuum outlet valve is movable in an upward and downward motion and is contained within a cylindrical tube.

5. The foam pump of claim 1 further comprising a pressurized air inlet valve located in fluid communications with the pressurized air inlet to prevent fluid from flowing out of the chamber and through pressurized air inlet.

6. The foam pump of claim 1 further comprising a trap located in the pressurized air inlet to prevent fluid from flowing out of the chamber and through the pressurized air inlet.

7. The foam pump of claim 1 further comprising a liquid container holding a supply of foamable liquid.

8. The foam pump of claim 7 wherein the liquid container is located below the chamber.

9. The foam pump of claim 7 wherein the liquid container is located above the chamber.

10. The foam pump of claim 1 wherein vacuum pump and air pump are same pump.

11. The foam pump of claim 1 wherein the vacuum outlet and the pressurized air inlet are the same port.

12. The foam pump of claim 1 wherein the vacuum outlet and the pressurized air inlet comprise connectors for releasably connecting to a vacuum pressure source and a pressurized air source.

13. A method of operating a foam pump comprising:

providing a refill unit having a foamable liquid container having a supply of foamable liquid;

a chamber in fluid communication with the foamable liquid container;

a vacuum outlet into the chamber;

a pressurized air inlet into the chamber; and a liquid air mixture outlet;

connecting the refill unit to a dispenser;

drawing vacuum pressure on the vacuum outlet into the chamber to draw liquid from the foamable liquid container into the chamber;

forcing pressurized air into the chamber to mix with the liquid; and forcing the pressurized liquid air mixture through a mix media and out of an outlet.

14. The method of claim 13 further comprising continuing to draw vacuum pressure while forcing pressurized air into the chamber.

15. The method of claim 13 further comprising stopping drawing a vacuum pressure when a voltage on the vacuum pump increases to indicate that the vacuum outlet is blocked.

16. The method of claim 15 wherein a valve blocks the vacuum outlet to stop drawing a vacuum pressure.

17. A dispenser comprising:

a vacuum pump;

an air pump;

circuitry for controlling the vacuum pump and the air pump a sensor for sensing an object;

a refill unit for releasably connecting to the vacuum pump and the air pump;

the refill unit including;

a liquid container for holding a foamable liquid;

a chamber; the chamber having a vacuum outlet port;

a air pressure inlet port;

a liquid inlet; and a liquid air mixture outlet;

a mix media; and a dispense outlet;

wherein the vacuum pump applies a negative pressure to the vacuum outlet port; and the air pump applies a positive pressure to the air pressure port when the sensor detects an object.

18. The dispenser of claim 17 wherein the vacuum outlet port and the air pressure inlet port are the same port.

19. The dispenser of claim 17 wherein the vacuum pump and the air pump are the same pump.

20. The dispenser of claim 17 wherein the refill further includes a vacuum outlet port valve for sealing off the vacuum outlet port when a desired amount of liquid is in the chamber.

* * * * *